US005316528A

United States Patent [19]

Ziparo

[11] Patent Number: 5,316,528

[45] Date of Patent: May 31, 1994

[54] FITNESS APPARATUS USABLE FOR MULTIPLE AEROBIC AND ANAEROBIC EXERCISE ROUTINES

[75] Inventor: Joseph A. Ziparo, Liverpool, N.Y.

[73] Assignee: Full Range, Inc., E. Syracuse, N.Y.

[21] Appl. No.: 6,767

[22] Filed: Jan. 21, 1993

[51] Int. Cl.[5] ..... A63B 22/04

[52] U.S. Cl. ..... 482/52; 482/142; 482/148

[58] Field of Search ..... 482/51, 52, 148, 904, 482/133, 142, 104, 25, 23, 30, 35, 70, 140, 146

[56] References Cited

U.S. PATENT DOCUMENTS

| | | | |
|---|---|---|---|
| 258,372 | 2/1981 | Pearo | 482/142 |
| 591,063 | 10/1897 | Spills . | |
| 1,013,685 | 1/1912 | Reach | 482/25 |
| 1,104,505 | 7/1914 | Holworthy | 482/38 |
| 4,211,403 | 7/1980 | Caffaro | 482/104 |
| 4,337,942 | 7/1982 | Sidlinger et al. . | |
| 4,477,070 | 10/1984 | Appelbaum | 482/51 |
| 4,561,652 | 12/1985 | Wilkinson . | |
| 4,582,319 | 4/1986 | Luna | 482/104 |
| 4,635,934 | 1/1987 | Roethke | 482/104 |
| 4,637,608 | 1/1987 | Owens et al. | 482/104 |
| 4,815,746 | 3/1989 | Ward, Jr. | 482/104 |
| 5,037,084 | 8/1991 | Flor . | |
| 5,050,861 | 9/1991 | Thomas et al. | 482/51 |
| 5,125,884 | 6/1992 | Weber et al. | 482/142 |
| 5,160,302 | 11/1992 | DuPont | 482/142 |

*Primary Examiner*—Stephen R. Crow
*Assistant Examiner*—Jerome Donnelly
*Attorney, Agent, or Firm*—George R. McGuire

[57] ABSTRACT

Apparatus for use in performing both anaerobic and aerobic exercise routines includes a bench having a body support platform with a plurality of legs and a rigid frame with at least one laterally extending cross piece at the forward end. A tubular member is affixed to the cross piece, in forwardly spaced relation thereto, extending vertically with its lower end in the said plane as the lower ends of the legs. A rod is telescopingly received in selectively adjustable relation to the tubular member, and a stability bar is affixed in a T-shaped configuration to the rod. A step is selectively positionable at the forward end of the bench with a notch in the step embracing the tubular member and a vertical surface of the step abutting the frame cross piece.

17 Claims, 3 Drawing Sheets

FITNESS APPARATUS USABLE FOR MULTIPLE AEROBIC AND ANAEROBIC EXERCISE ROUTINES

BACKGROUND OF THE INVENTION

The present invention relates generally to exercise benches, and more particularly to exercise benches used for a large variety of aerobic and anaerobic exercise routines.

In the past, great emphasis was placed on anaerobic activity, i.e., weight training. To assist in making weight lifting safer and more productive, a variety of weight lifting benches were developed, e.g., horizontal bench, inclined bench. Many modifications have been made to the structure of these benches to improve upon such factors as comfort, safety, and ease in use, but no modifications have been made which would alter their utility and increase their functionality.

With the upsurge in popularity of aerobic activity, and in particular "step aerobics", a need for a fitness device which provides the equipment necessary to properly perform the desired routines has developed. In addition, it has been determined that in order to achieve a maximum level of physical fitness, a combination of aerobic and anaerobic exercise is necessary. It would therefore be desirable to have a fitness device which provides the user with the capabilities of performing both aerobic and anaerobic routines.

It is a primary object of this invention to provide a fitness bench which will provide both aerobic and anaerobic exercise capabilities.

It is a secondary object of the present invention to provide a fitness bench which will facilitate ease, comfort, and safety in use.

Other objects will in part appear hereinafter and in part be obvious.

SUMMARY OF THE INVENTION

In order to attain the objects as previously set forth, according to the present invention, there is provided a fitness bench having a fixed frame supporting a horizontally oriented platform, a stability bar assembly extending upwardly and laterally at the front end of the bench, a pair of outriggers fixedly connected to and extending outwardly from a respective pair of legs positioned at the front end of the bench, and a modular step which may be positioned adjacent the front end of the bench, in structural cooperation with the fixed frame. The frame is comprised of a upper and lower support rods fixedly attached at their opposite ends to respective pairs of the four, legs at the respective four corners of the frame. Additional stability is provided by a pair of outriggers which are fixedly connected to and extend forwardly and outwardly from the two legs positioned at the front end of the bench.

The stability bar assembly is comprised of a vertically oriented sleeve the lower end of which contacts the floor, a telescoping rod which slidingly engages the sleeve, and an elongated, horizontally positioned rod which is fixedly connected, at its midpoint, to the upper end of the telescoping rod. The sleeve further has a pair of axially aligned apertures formed therethrough at its upper end. The telescoping rod has a plurality of pairs of axially aligned apertures along its length. A pin inserted through the apertures in the sleeve and the aligned apertures in the telescoping rod suports the horizontal stability bar at a desired elevation.

The stability bar assembly is fixedly connected to the bench by two stub shafts. Each shaft is fixedly connected at one end to the sleeve and at the other end to one of the upper and lower support rods. The stub shafts provide a clearance between the bench and the stability bar assembly. This clearance allows the user to perform exercises which require lying on the platform without interference from the stability bar assembly.

A modular step is provided for use in particular aerobic routines. The step is positioned adjacent the front of the bench and the stability bar. A notch is cut out of the step's front face to allow the step to be securely positioned with the notch embracing the vertical sleeve and the front face of the step against the frame. This leaves no gaps between the step and the bench, thus providing a safe exercise environment.

This combination of structure provides advantages for both aerobic and isometric exercise. When used as an aerobic tool, the step should be positioned adjacent the stability bar assembly, and the horizontal stability bar should be selectively positioned to the proper height of the user. This height should be determined by standing flat on the step, placing your arms by your side and then raising the lower arms to 90 degree angles with respect to the upper arms. This is the height that should be selected to maximize the aerobic workout. By holding on to the bar and performing a series of stepping moves, the user not only works the cardiovascular system but also gives good stretching activity to the muscles in the upper body. To be used as an isometric tool, the stability bar should be positioned in its lowest position. The user can then use the bench for a variety of exercises such as leg lifts and stomach crunches while holding on to the stability bar for support. This extra safety feature allows the user to concentrate more on the exercise and thus use better form and obtain better results from the workout.

DETAILED DESCRIPTION OF THE PREFERRED EMBODIMENT

Figure 1:
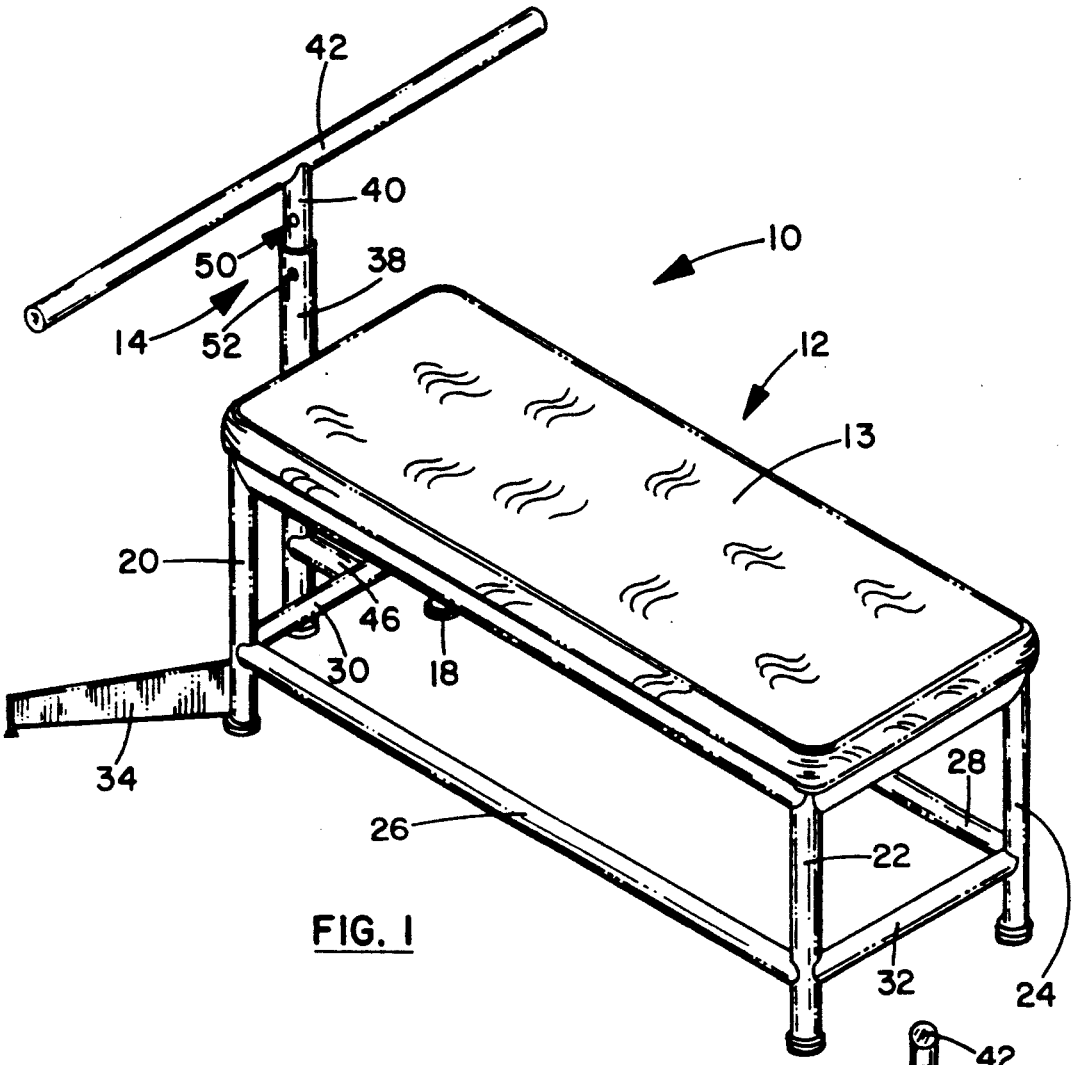
FIG. 1 is a perspective view of the fitness bench of the present invention.
Figure 2:
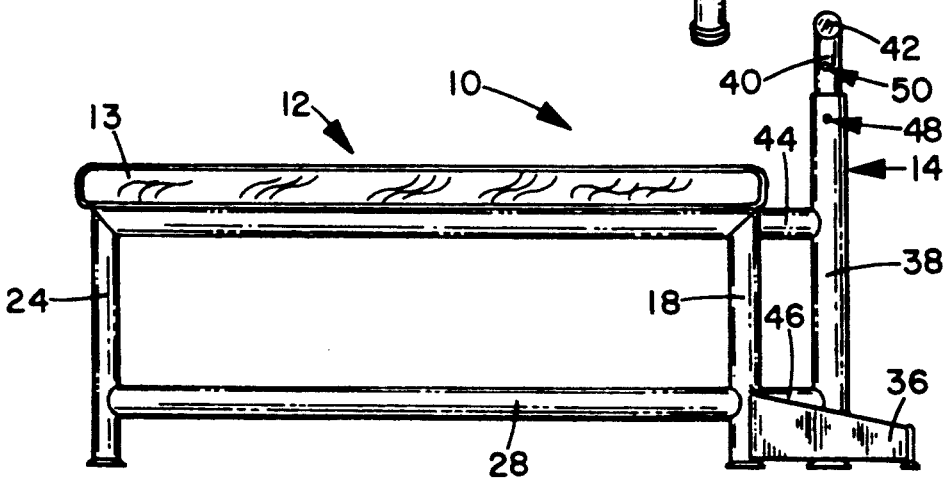
FIG. 2 is a side elevational view.
Figure 3:
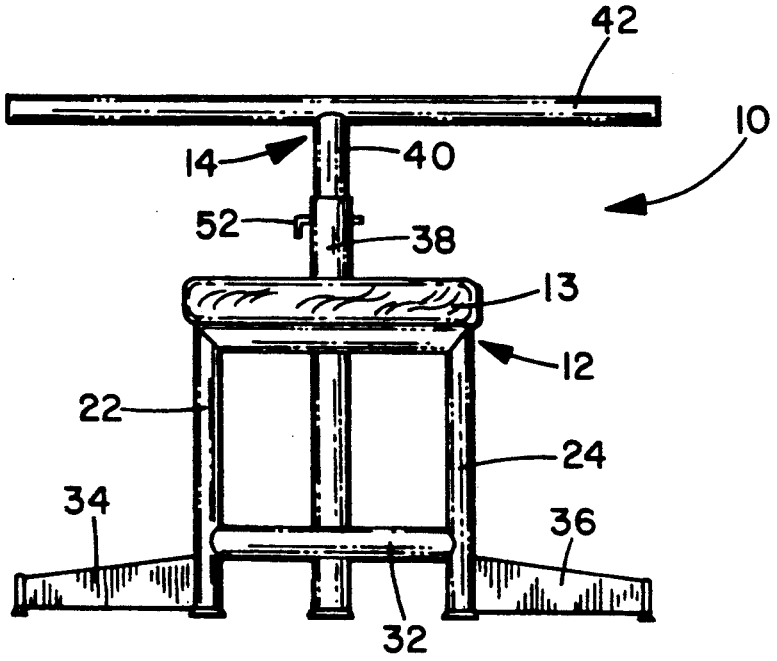
FIG. 3 is a rear elevational view.
Figure 4:
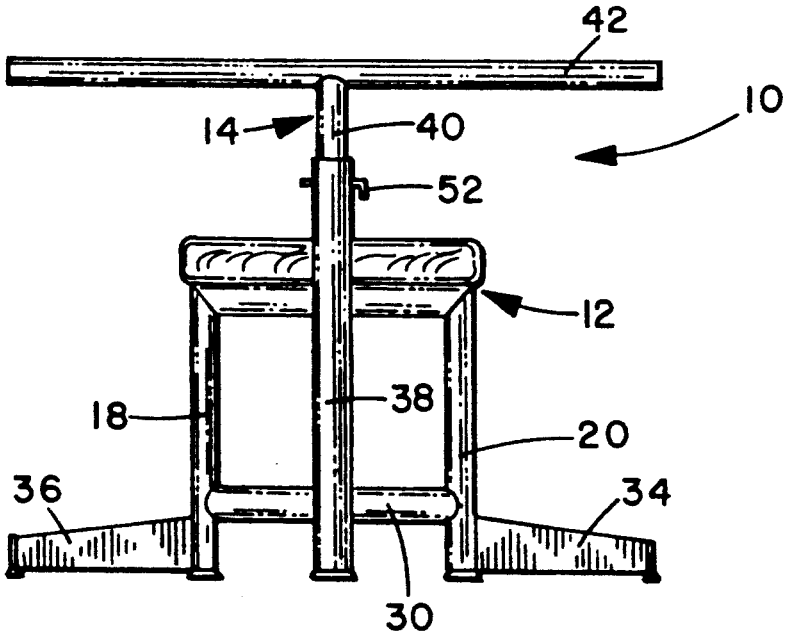
FIG. 4 is a front elevational view.
Figure 5:
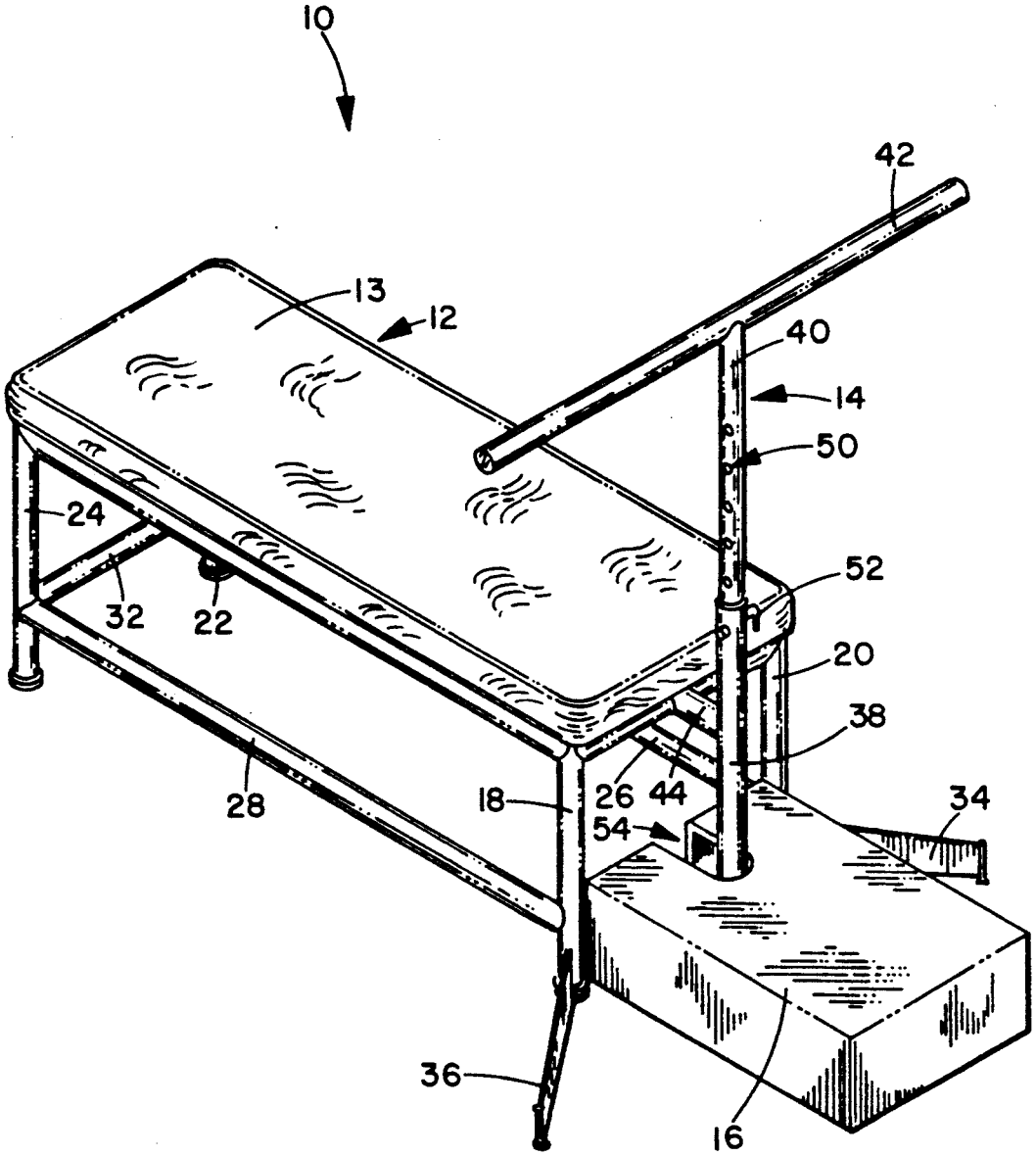
FIG. 5 is a second perspective view showing the step positioned at one end of the fitness bench.

Referring now to the drawing figures, the apparatus of the present invention is generally denoted by reference numeral 10. Apparatus 10 is generally comprised of three major components, namely bench 12, stability bar assembly 14, and modular step 16 (shown only in FIG. 5).

Bench 12 is designed primarily for the safety and comfort of the user. Bench 12 includes rectangular support platform 13 having a rigid base covered by a resilient material to ensure the comfort of the user. Platform 13 is supported horizontally by four, equally long, legs 18, 20, 22 and 24. To provide a stable fixed frame two sets of elongated rods 26, 28, 30 and 32, and 27, 29, 31, and 33 are perpendicularly interconnected between each adjacent pair of the legs 18, 20, 22 and 24. Rods 26–29 are of a first length, substantially equal to the length of bench 12, and rods 30–33 are of a second length, substantially equal to the width of bench 12. Rods 26–33 each have linear axis which extend in a horizontal plane substantially parallel to the floor. To provide further stability of bench 12, a pair of outriggers 34 and 36 are provided. Outriggers 34 and 36 are fixedly connected to legs 20 and 18, respectively, and extend outwardly therefrom such that the angles formed between rod 30 and outriggers 34 and 36 are preferably about 135 degrees. Outriggers 34 and 36 are shown as having a trapezoidal shape but any shape would suffice as long as it has a flat bottom surface in the same plane as the lower surfaces of legs 18, 20, 22, and 24.

Stability bar assembly 14 is positioned adjacent the front end of bench 12 between outriggers 34 and 36. Bar assembly 14 is comprised of a tubular sleeve 38, a telescoping rod 40 which slidably engages sleeve 38, and a rod 42 which is orthogonally, fixedly connected to the upper end of telescoping rod 40 at the midpoint of rod 42 such that the two rods integrally form a T. Sleeve 38 extends vertically upward from the floor (i.e., the lower end of lee 38 i in the sme plane a the lower surfaces of legs 18, 20, 22 and 24, and outrigers 34 and 36) and has two axially aligned apertures formed therethrough adjacent its top. Rod 40, which slidingly engages sleeve 38, is provided with a plurality of axially aligned pairs of apertures 50. Thus, rod 40, and hence rod 42, may be positioned to any desired height simply by placing pin 52 through the apertures in sleeve 38 and the aligned pair of apertures 50. When pin 52 engages the apertures, rod 42 is positioned some distance above platform 13 and its longitudinal axis is perpendicular to the longitudinal axis of bench 12. The height should be adjusted by the user, as explained later.

Sleeve 38 is fixedly attached to bench 12 via stub shafts 44 and 46. Stub shaft 44 extends between rod 31 and sleeve 38 while stub shaft 46 extends between rod 30 and sleeve 38. Having shafts 44 and 46 separate stability bar assembly 14 from bench 12 allows bench 12 to be used with no interference from assembly 14. This is desirable when performing exercises on bench 12 such as leg lifts and stomach crunches.

When performing certain exercises i.e., step aerobics, it is necessary to use modular step 16. When used, step 16 is positioned adjacent the front end of bench 12 and stability bar assembly 14, and between outriggers 34 and 36. Step 16 is provided with a notch 54, allowing step 16 to snugly embrace sleeve 38 and stub shaft 46, abutting rod 30 at the front end of bench 12. By fitting step 16 to the bench in this manner, no gaps are left between step 16 and bench 12. Thus, the chances of the user slipping off step 16, or of the step shifting or tipping during use are virtually eliminated and concentration may be fully directed to the exercise routine. Step 16 is illustrated as rectangular in plan view, but any shape will suffice provided the upper surface is horizontal. The lower surface of step 16, which may simply be formed by the lower edges of the front, back and side panels of the step, rests upon the floor in the same plane as the lower ends of legs 18, 20, 22 and 24. The intended purpose of step 16 is to permit a variety of "step" aerobic routines to be performed, but other uses for step 16 may be found.

The fitness apparatus may be used for a variety of independent exercises as well as specific aerobic routines. While working out on the bench itself, with the stability bar at or near its lowest position, as in Figure exercises can be performed which concentrate on such areas as the abdomen, thighs, chest, buttocks, etc. without exerting undue stress on the neck or lower back. Bar 42 may be grasped with one or both hands to stablize a user lying in virtually any position on platform 13.

Specific aerobic routines were designed for use with this bench which allow a full range of muscular activity to occur. These routines emphasize stretching, twisting, and leg lifts, and with proper body positioning provide isometric activity to the arms, shoulders, neck and upper back. The optimum body position is maintained by positioning bar 42 at the height of the user's hands while standing on step 16 and extending the forarms horizontally with the upper arms at the sides. Having bar 42 positioned at this height maximizes the aerobic workout not only by working the cardiovascular system, but also providing a full range of stretching to the muscles in the upper body. Examples illustrating some of these unique routines are as follows:

SIDE TWIST

Begin with both feet on the floor forwardly of the step and both hands on the stability bar 42. Step onto the step with the right foot and then follow with the left. Step down to the right of the step with the right foot and swing the left leg across the body returning the left foot to the step at the end of the motion. Return the right foot to the step. Step down to the left of the step with the left foot and swing the right leg across the body and returning the right foot to the step at the end of the motion. Return the left foot to the step. Continue the above process for as long as desired keeping in mind that the hands should not leave bar 42 and the shoulders should remain parallel to bar 42 throughout the routine.

LEG LIFTS

Begin with both feet on the floor forwardly of the step and both hands on the stability bar. Step onto the step with the right foot. Straighten the right leg so the left leg is fully extended with the left foot pointing towards the floor. Straighten the arms and raise the fully extended left leg up as far as possible. The left leg may then be repetitiously brought in and pushed back out, or lowered and raised, whichever motion is desired. Repeat the process for the right leg. As with the previously described routine, the hands should remain on the stability bar and the shoulders should remain parallel to the stability bar throughout the routine.

THE FIVE STEP

Begin with both feet on the step and both hands on the stability bar. Step down off the step with the right foot. Bring the left foot behind the right leg, stretching as far as possible. Raise the left leg up to the side, again stretching as far as possible. Place the left foot back on the step and follow with the right. Continue the same process on the other side and repeat as often as desired.

Of course, exercise bench 12 and stability bar assembly 14 may be used for many routines other than those just described. Bench 12 and bar assembly 14 provide a very stable device for stretching and performing other exercises, both when utilizing step 16 and when lying on platform 13, which require balance and support.

What is claimed is:

1. An exercise device useful for performing a variety of aerobic and isometric fitness routines, said device comprising:

a) a bench having front and rear ends, longitudinal and transverse axes, a user supporting surface lying in a substantially horizontal first plane, and a plurality of downwardly projecting, horizontally spaced supports, each of said supports being of substantially equal length and having lower ends in a second plane substantially parallel with said first plane;

b) a pair of stability supports fixedly connected to and extending outwardly, at a predetermined obtuse angle with respect to the longitudinal axis of said bench, from a respective pair of said downwardly projecting supports positioned at said front end of said bench;

c) user stability means having a first hollow, tubular member of predetermined diameter extending perpendicularly upwards from a lower end in said second plane to an upper end, means rigidly connecting said member to said front end of said bench, a second tubular member slidingly engaging said first tubular member, said second tubular member having first and second opposite ends, said first end being positioned within said first tubular member and said second end being positioned a predetermined distance above said first end, and a third tubular member having opposite ends and a linear axis, said third tubular member being perpendicularly, fixedly connected to said second end of said second tubular member at substantially the midpoint of said third tubular member such that said linear axis of said third tubular member is substantially parallel with said transverse axis of said bench; and d) a modular step positioned adjacent said user stability means opposite said front end of said bench, said step having planar top and bottom surfaces and a front wall, a rear wall, and a plurality of sidewalls integral with and extending between said top and bottom surfaces, said front wall being positioned adjacent said front end of said bench, said step further having a notch of predetermined width formed in said front wall and said top and bottom surfaces of said step for positioning said step around said first tubular member of said stability means and flush with said front end of said bench.

2. The invention according to claim 1 wherein said user supporting surface is composed of a firm and resilient material.

3. The invention according to claim 1 wherein said bench further comprises first and second sets of horizontally extending support rods, said first and second sets each having first, second, third, and fourth members,said first and second members being of a first length and said third and fourth members being of a second length shorter than that of said first length, said first, second, third, and fourth members each having first and second opposite ends, said first, second, third, and fourth members perpendicularly extending between a pair of said adjacently positioned, downwardly projecting supports, said first set of support rods extend in a third horizontal plane adjacent and parallel to said first plane and said second set of support rods extend in a fourth horizontal plane parallel with and lying between said second and third planes.

4. The invention according to claim wherein said pair of stability supports are outriggers having a planar bottom surface which lie in said second plane.

5. The invention according to claim 1 wherein said predetermined obtuse angle of said stability supports is approximately 135 degrees with respect to said longitudinal axis of said bench.

6. The invention according to claim 1 wherein said means connecting said first tubular member to said bench are stub shafts of a predetermined length.

7. The invention according to claim 6 wherein said stub shafts are between about 3 and 6 inches long to provide a clearance between said first tubular member and said front end of said bench.

8. The invention according to claim 1 wherein said selective communication means comprise a pair of axially aligned apertures formed through said first tubular member, adjacent said second end of said first member, a plurality of pairs of axially apertures formed through said second tubular member, between said first and second ends of said second tubular member, and a pin which engages said pair of apertures in said first tubular member and said desired pair of apertures in said second tubular member.

9. The invention according to claim 10 wherein said width of said notch is approximately equal to said diameter of said first tubular member.

10. Fitness apparatus useful in performing both aerobic and anaerobic physical exercises, said apparatus comprising:

a) a fixed frame having a forward end and a plurality of legs rigidly interconnected with one end of each in a common horizontal plane;

b) a platform supported upon said frame and having a central longitudinal axis passing through said forward end and an upper surface adapted to support the body of a user while performing anaerobic exercises;

c) an elongated stability bar;

d) means for maintaining said stability bar in a substantially horizontal orientation, perpendicular to said longitudinal axis and adjacent said forward end of said frame;

e) means for selectively adjusting the vertical height of said stability bar between upper and lower limits;

f) a member fixedly attached to said frame in forwardly spaced relation to said forward end thereof; and g) a step having a first surface positioned in abutting relation to said forward end of said frame, a second surface in said common horizontal plane, a third surface parallel to and spaced a predetermined distance above said second plane, and a notch extending inwardly from said first surface, through both said second and third surfaces, said member extending through said notch, whereby a user may perform aerobic exercise routines stepping on and off said third surface while grasping said stability bar.

11. The apparatus of claim 10 wherein said means for maintaining said stability bar in a substantially horizontal position comprises a second, vertical rod fixedly attached to said stability bar in a T-shaped configuration.

12. The apparatus of claim 11 wherein said adjusting means comprise means for releasably fixing said second rod to said member in a plurality of relative positions.

13. The apparatus of claim 12 wherein said member comprises a tubular member telescopingly engaged with said second rod, and said means for releasably affixing comprise a plurality of selectively alignable apertures in said tubular member and said second rod, and a pin insertable through apertures in said second rod which are aligned with apertures in said tubular member.

14. The apparatus of claim 13 wherein said frame includes at least one cross piece extending laterally across said forward end and fixedly attached to each of a pair of said legs, and further including means fixedly attaching said tubular member to said cross piece.

15. The apparatus of claim 14 wherein said tubular member is elongated between first and second ends and is fixedly attached to said cross piece with said first end in said common horizontal plane.

16. The apparatus of claim 15 wherein said means fixedly attaching said tubular member to said cross piece comprises a stub shaft extending forwardly from said cross piece, whereby said tubular member is positioned a predetermined distance forwardly of said cross piece.

17. The apparatus of claim 10 wherein said member has a predetermined width and is positioned to perpendicularly intersect said longitudinal axis of said platform, said notch having a width substantially equal to said predetermined width and a depth substantially equal to said predetermined distance.

* * * * *